US005102137A

United States Patent [19]

Ekiert

[11] Patent Number: 5,102,137

[45] Date of Patent: Apr. 7, 1992

[54] DIVIDED TABLE GAMING MACHINE

[75] Inventor: Andrew Ekiert, Bronte, Australia

[73] Assignee: Ainsworth Nominees Pty., Ltd., Rosebery, Australia

[21] Appl. No.: 589,576

[22] Filed: Sep. 28, 1990

[51] Int. Cl.[5] ..... A63F 5/04

[52] U.S. Cl. ..... 273/143 R

[58] Field of Search ..... 273/138 A, 143 R; 364/412

[56] References Cited

U.S. PATENT DOCUMENTS 3,918,716 11/1975 Nonaka et al. .
4,448,419 5/1984 Telnaes .
4,467,143 7/1984 Hagiwara .
4,492,379 1/1985 Okada .
4,573,681 3/1986 Okada ..... 273/143 R
4,711,451 12/1987 Pajak et al. .
4,772,023 9/1988 Okada .
4,858,932 8/1989 Keane .

FOREIGN PATENT DOCUMENTS

035272/84 11/1083 Australia .
280649 9/1964 Australia .
557348 4/1984 Australia .
21918/88 9/1987 Australia .
23593/88 4/1989 Australia .
2201279 2/1987 United Kingdom .

*Primary Examiner*—William H. Grieb
*Attorney, Agent, or Firm*—Armstrong, Nikaido, Marmelstein, Kubovcik, and Murray

[57] ABSTRACT

The present invention relates in particular to an improved gaming machine wherein the probability of winning combinations occurring may be altered with regard to conventional machines without changing the number of actual symbols or indicia available. This is carried out by assigning to each indicia on a reel or disc a particular random number from a plurality of available random numbers. The plurality of available numbers, one for each indicia, are divided into a plurality of subset tables. Prior to selecting a random number for choosing a particular indica, a selection of a subset table is made, preferably in a weighted manner, and the random number is then chosen from the particular subset table. By including the jackpot symbols in one particular subset table, for example, and weighting this selection of tables so that this subset table is chosen only infrequently, the amount of the jackpot available can be increased because the odds of obtaining the jackpot have been decreased without increasing the number of symbols on the reel or disc.

29 Claims, 6 Drawing Sheets

DIVIDED TABLE GAMING MACHINE

BACKGROUND OF THE INVENTION

Figure 1:
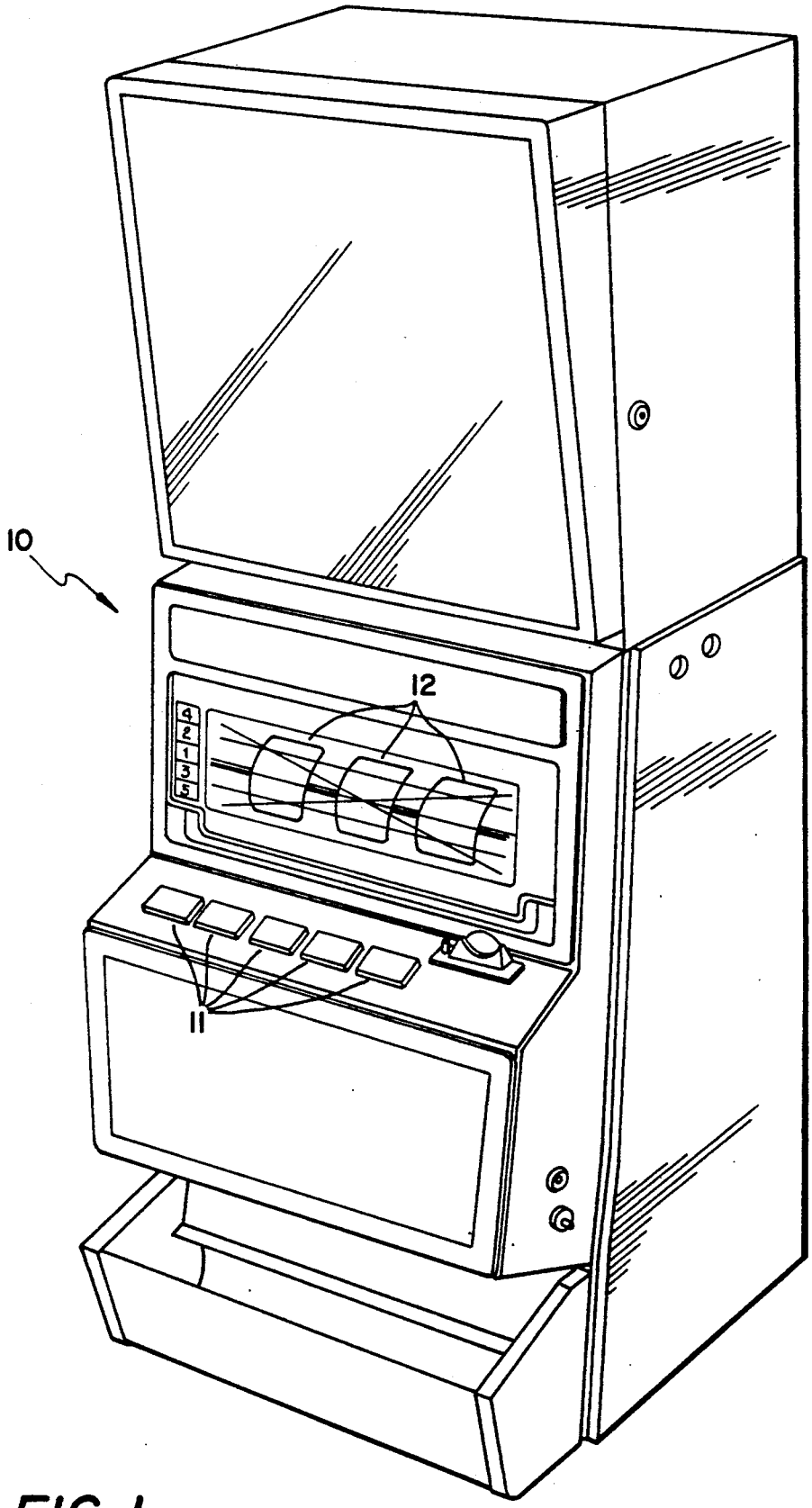

The present invention relates to gaming machines, in particular to gaming and slot machines such as poker machines, fruit machines, video gaming machines, video draw card poker machines and the like. In particular, the invention relates to an improved gaming machine wherein the probability of winning combinations occuring may be altered with regard to conventional machines without changing the number of actual symbols or indicia available e.g. the predetermined number of symbols which are available on a rotatable reel or reel-type gaming machine, or alternatively, that the number of physical symbols or indicia may be decreased, with a consequential increase in symbol size where the symbols are mounted on a reel, without altering the probability of winning combinations provided on the machine occurring.

The invention particularly, but not exclusively, relates to slot machines common to casinos and clubs where the player inserts coins into the machine and spins at least one rotatable reel by handle or button whereupon the reel or reels become stopped at random, and if the stop symbols coincide with the pay schedule or score card the player is paid a prize. If it is a multi-coin machine the player may buy extra chances or multiply potential winnings.

In a preferred embodiment the present invention applies to slot machines with reels, the stopping position of which is random but under the control of a microprocessor; machines of this type are described in British patent No. 1550732 by PBR and U.S. Pat. No. 4,095,795 by Saxton.

In a bid to attract players, casinos have offered higher and higher jackpots, and as these are a percentage of revenue the chances of striking a jackpot have to be proportionally less. This was attained in the past, in reel machines, by increasing the number of reels and increasing the number of symbols on a reel.

With the development of microprocessor control gaming machines, where the stopping position of the reel is determined by the microprocessor, a new approach was taken. Telnaes U.S. Pat. No. 4,448,419 selected stopping positions from a virtual reel strip or memory table within the microprocessor which had more virtual positions than there were physical stop positions on the reel itself. By mapping several of these virtual positions to one of the reel symbols, the probability of the reel showing one symbol became different to that for showing others of the symbols. For example, a jackpot symbol can be made to appear with less frequency than other symbols.

With the same intention, U.S. Pat. No. 4,858,932 to Keane selects the reel stopping position from a series of random numbers divided into the same number of groups as there are reel positions; however the size of each group is unequal, thereby causing the appearance of a jackpot or other symbol to be of unequal probability of appearing on a pay line.

Kabushiki Kaisha Universal also describe an arrangement in their Australian patent No. 561873 in which the slot machine periodically checks the prize value paid by the machine over the preceding period, and if this value is too high the machine adjusts the operation of the machine to make it harder for the player to win. The Kabushiki Kaisha Universal machine is of the type where the reels are stopped under player control by the player pressing a stop button and winning is made harder by introducing a delay in the reel stopping sequence after the stop button is pressed. British patent No. 2201279 (Chadwick) and U.S. Pat. Nos. 4,711,451 (Pajak) and 4,467,143 (Hagiwara) also describe methods of reducing the pay out rates of slot machines, but generally by changing the pay out for a given result rather than by changing the probability of the result occurring.

The present invention provides a gaming machine comprising display means arranged to display at least one indicium selected from a set of a plurality of possible indicia, random selection means arranged to select the indicia to be displayed on said display means from said set of indicia, the random selection means including random number generation means arranged to select a random number from a set of numbers having a member uniquely corresponding to each indicium of the set of possible indicia, wherein the set of numbers are divided between a plurality of subset tables, at least one of the subset tables containing a plurality of members, and selection means arranged to select between the subset tables to select a subset table as the table to be used for a current game on the machine, whereby the random number generator makes its selection from the selected table and the display means is responsive to the selected number to display the corresponding indicium.

The selection means is preferably arranged to make a weighted selection between the subset tables. In this way, one of the tables can include a number corresponding to a jackpot symbol or indicium and the selection can be weighted towards the table which does not include the jackpot symbol or indicium, thus allowing one to increase the value of the jackpot without needing to increase the number of symbols or indicia available.

At least two of the subset tables may contain an unequal number of members to each other. For example, where there are two subset tables only, one could contain 17 numbers and the other could contain 3 numbers, one of the three numbers being a jackpot symbol.

The present invention further provides a method of operating a gaming machine, having display means arranged to display at least one indicia selected from a set of a plurality of possible indicia, the machine being provided with a plurality of numbers representing indicia displayable by the display means, each displayable indicium being represented by a corresponding respective number, the plurality of numbers being divided into a plurality of subset tables, at least one of the subset tables having a plurality of members, the method of operation comprising selecting an indicium for display by the steps of randomly selecting one of the subset tables, randomly selecting one number from the subset table and displaying the indicium corresponding to the selected number.

The present invention yet further provides a gaming machine comprising control means for controlling operation of the machine, display means including a plurality of display positions for displaying combinations of indicia and reward means for returning a reward to a player of the machine in response to certain predetermined indicia combinations being displayed on the display means at the end of the game, the display means including a plurality of reels mounting the indicia, random selection means arranged to select the indicia to be displayed by at least one of the reels from a set of a plurality of possible indicia for the at least one reel, the random selection means including random number generation means arranged to select a random number from a set of numbers having a member uniquely corresponding to each indicium of the set of possible indicia, wherein the set of numbers are divided between a plurality of subset tables, at least one of the subset tables containing a plurality of members, and selection means arranged to select between the subset tables to select a subset table as the table to be used for a current game on the machine, whereby the random number generator makes its selection from the selected table and the reel is responsive to the selected number to display the corresponding indicium.

Figure 2:
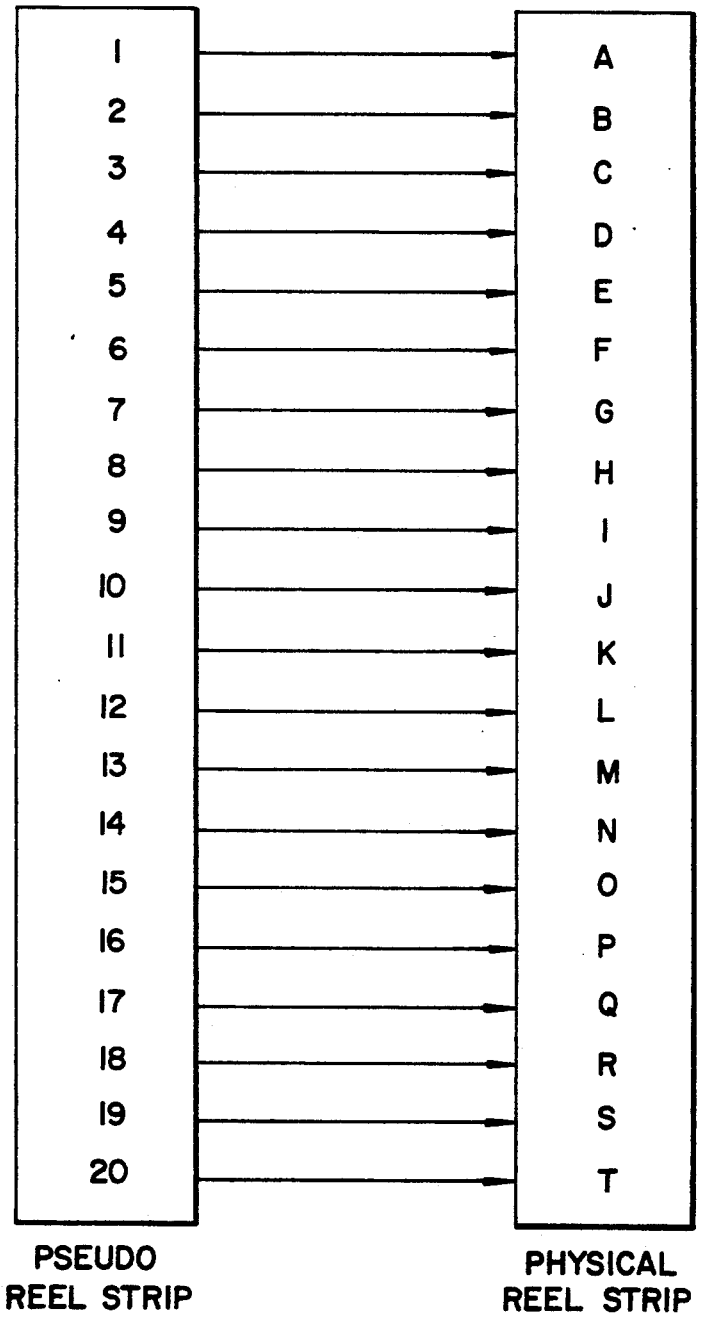
FIG. 2 PRIOR ART
Figure 3:
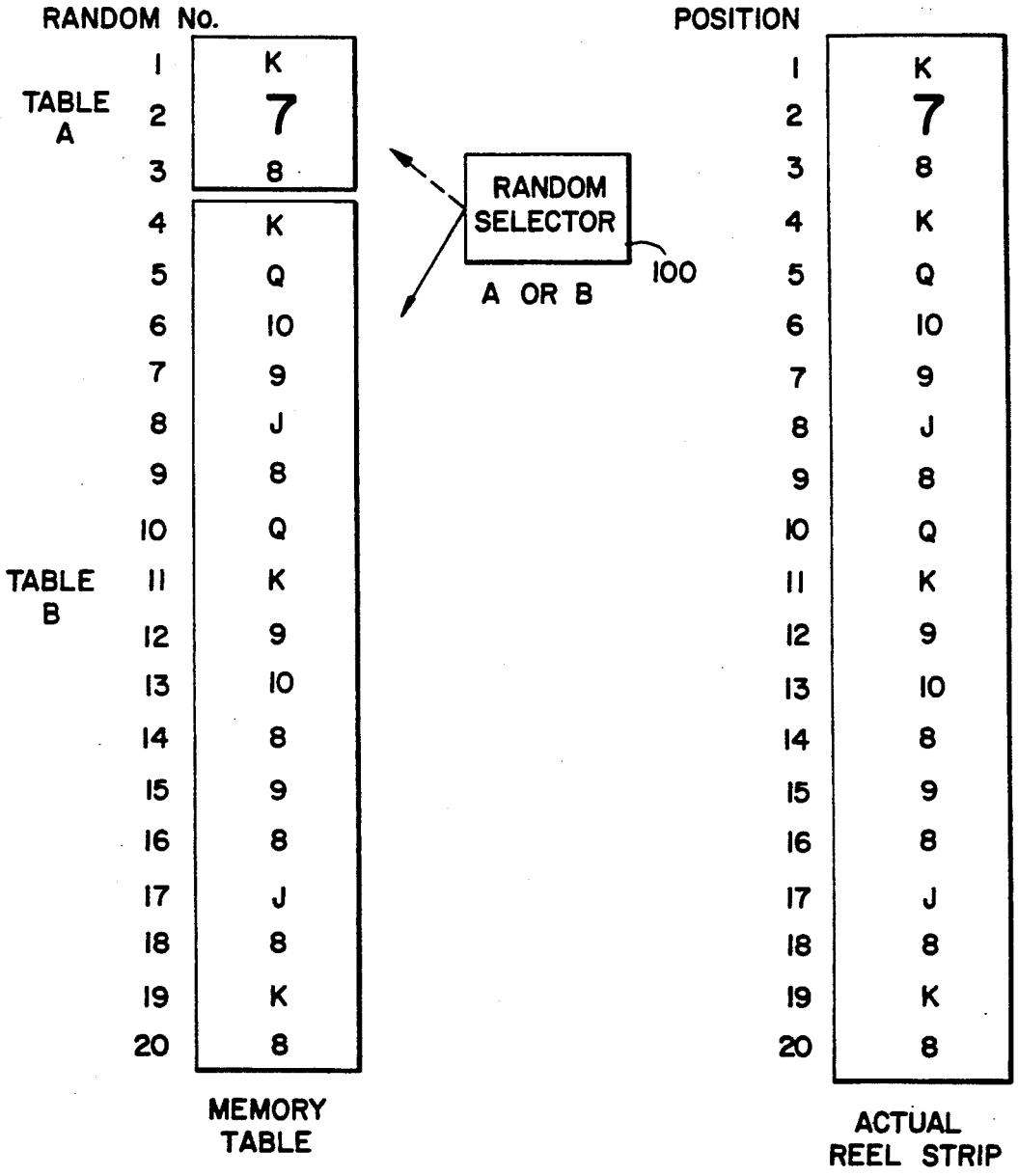
Figure 4:
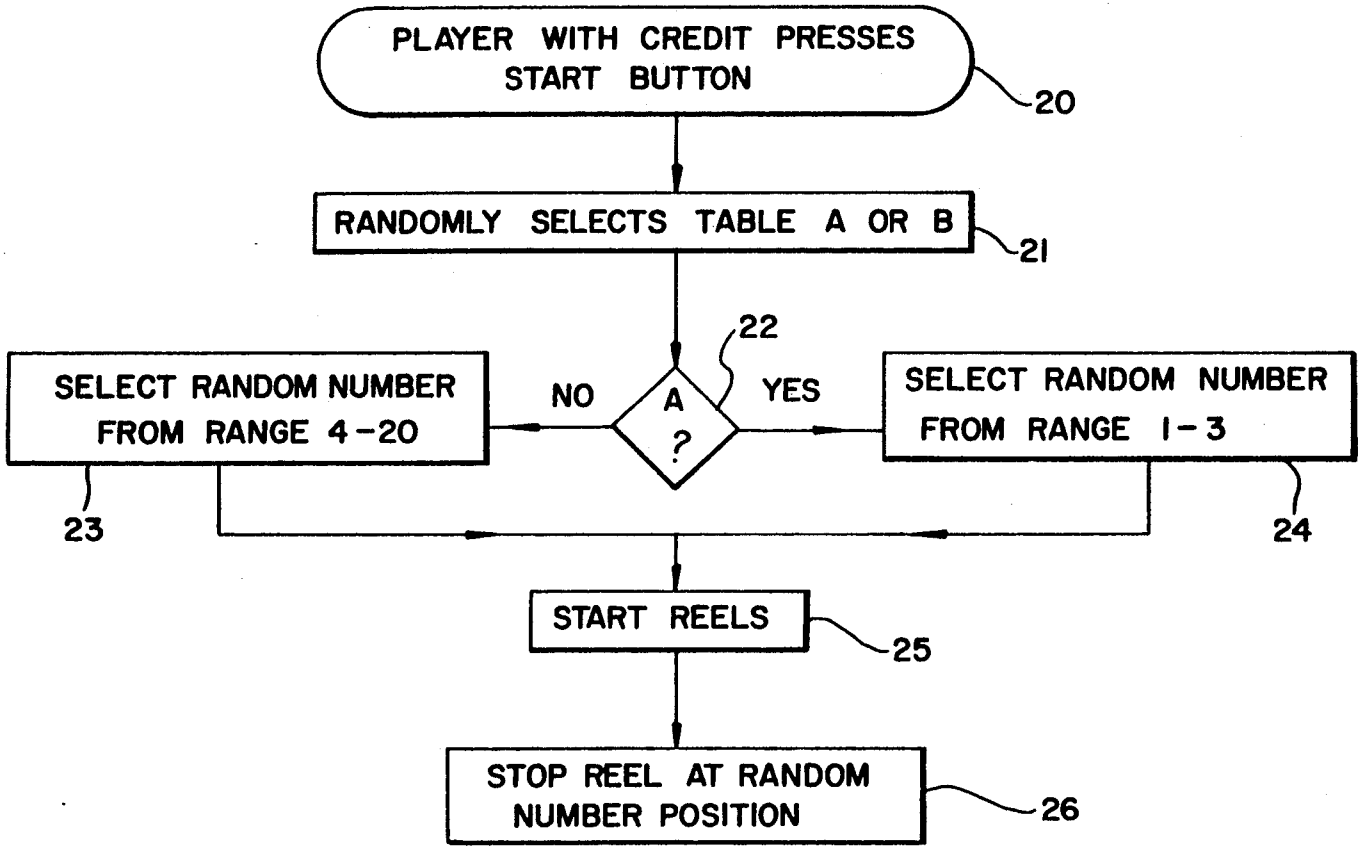
Figure 5:
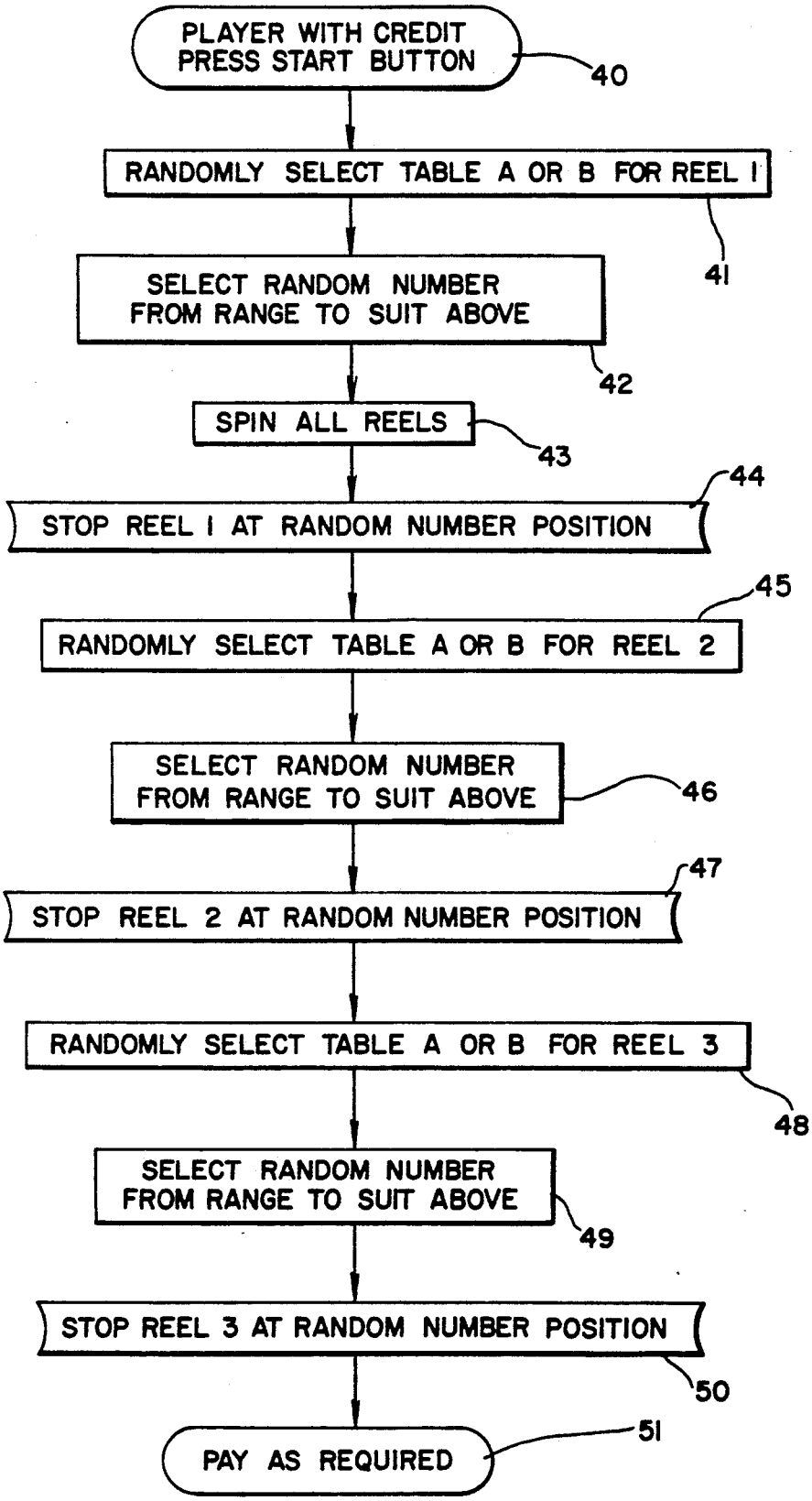
Figure 6:
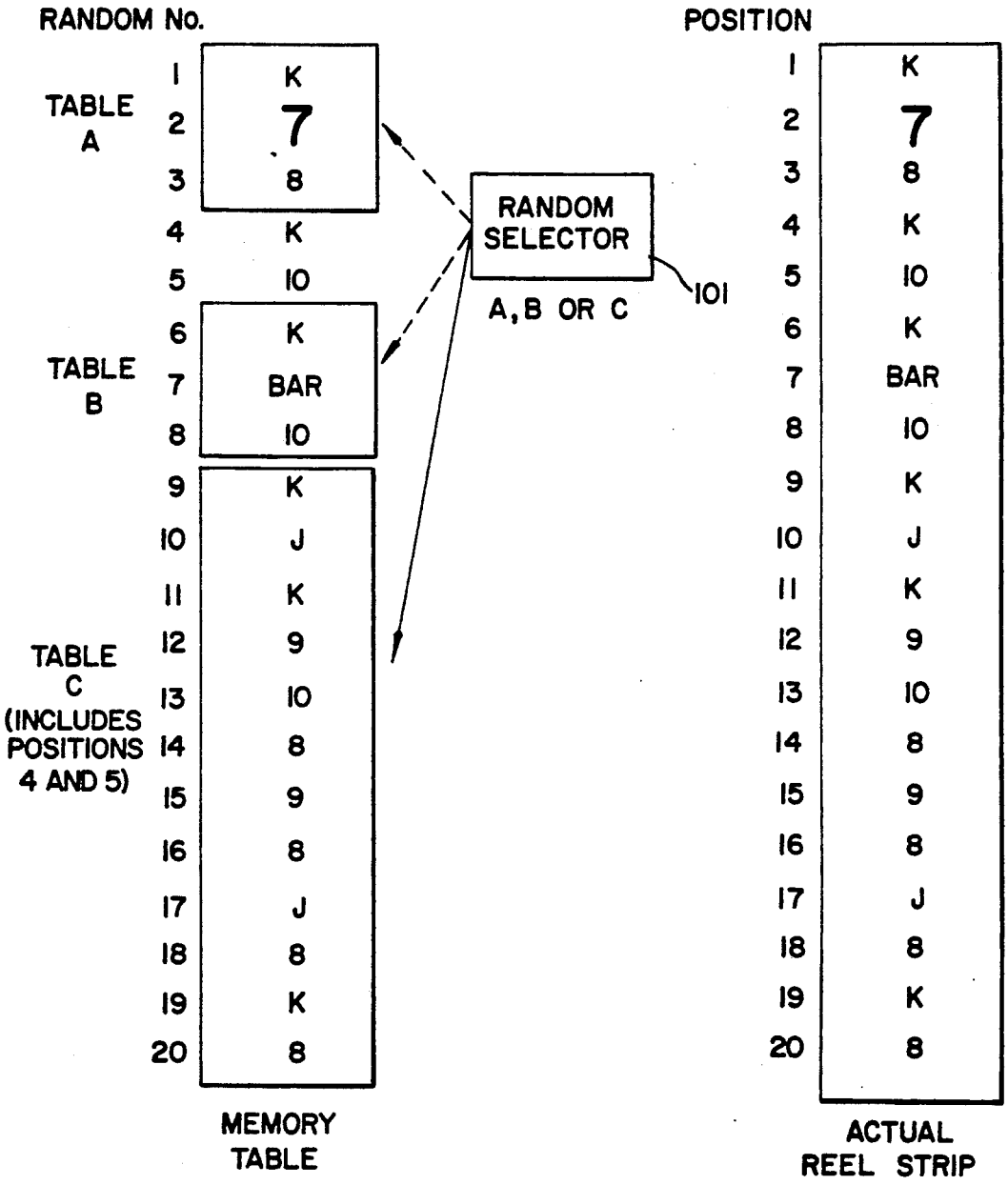

Features and advantages of the present invention will become apparent from the following description of an embodiment thereof, by way of example only, with reference to the accompanying drawings in which;

FIG. 1 illustrates a typical multi-line gaming machine to which the present invention might be applied;

FIG. 2 schematically illustrates a conventional prior art mapping arrangement;

FIG. 3 schematically illustrates a first reel mapping arrangement in accordance with the present invention;

FIG. 4 schematically illustrates a flow chart for reel control in an embodiment of the invention making use of the mapping arrangement of FIG. 3;

FIG. 5 illustrates a flow chart for control of the operation of a three reel gaming machine, each reel making use of the mapping arrangement of FIG. 3 for selection of the symbol to be displayed; and FIG. 6 schematically illustrates a second reel mapping arrangement in accordance with the present invention.

With reference to FIG. 1 a gaming machine, slot machine 10, according to the present invention is illustrated. Slot machine 10 is of the spinning reel type, having three spinning reels 12. A random number generator is provided, such that when a player operates one of the game starting switches 11, a set of random numbers are chosen with one number being chosen for each reel 12 of the machine. The set of random numbers available for at least one reel 12 are divided between a plurality of subset tables. A selection means is provided to select between the subset tables to select a subset table as the table to be used for a current game on the machine, and the random number generator makes its selection from the selected table and the indicia corresponding to the selected number is displayed by the at least one reel 12. By appropriate weighting of the selection process some indicia may be more likely to be chosen than others for the at least one reel 12. this opens up the possibility of increasing the amount of jackpot available without needing to increase the number of indicia on the reel, or the size of the reel, as in prior art machines.

The indicia for each of the three reels 12 may be selected by this process. Alternatively, one or two of the reels may be driven by a normal prior art process and only one reel is driven in accordance with the present invention.

In the preferred embodiment of the invention the slot machine display 12 is provided by a plurality of stepper motor driven reels each carrying a strip of indicia such that rotation and subsequent stopping of the reel leaves one of the indicium positioned in a window, this indicia being one of the selection of indicia which are used to determine the game result. In prior art machines the random number generator makes its selection from a fixed set of random numbers which are uniquely mapped to the physical reel as illustrated in FIG. 2. In FIG. 2 there are shown 20 random numbers as the "pseudo-reel strip". The random number generator of the prior art machine is arranged to select one of these twenty numbers and the reel is stopped at the appropriate point to display the indicia on the physical reel strip which corresponds to the random number chosen. For example, if random number 10 were chosen indicia J would be displayed on the physical reel strip.

In embodiments of the present invention the pseudo-reel strip is in the form of a "table memory" divided into a plurality of subset tables, as illustrated for example in FIG. 3. The total table memory comprises the same number of random numbers as there are reel strip positions. Unlike the prior art method, however, before a random number is chosen an extra selection process is carried out by a selection means. The selection means chooses one of the subset tables and then a random number is chosen from the particular subset table which has been selected. The chosen random number is mapped to the actual reel strip as per normal.

With reference to FIG. 3, there are two subset tables, table A and table B. Random selector 100 is arranged to choose either table A or B before a random number is chosen. In this case, table A contains a random number which is mapped to jackpot symbol "7". The random selector 100 is weighted so that it chooses table B in preference to table A. The jackpot symbol will thus have less likelihood of being chosen than it would in a normal prior art machine which does not have the extra selection process and subset table structure of the present invention. It is therefore possible to provide higher jackpots, which are more attractive to users of the gaming machine.

FIG. 4 shows a control process in flow chart form for control of one reel 12 of the slot machine 10 in accordance with the embodiment of FIG. 3. As a first step in selecting the stopping position for the reel a random table selection is made to determine which of the tables A and B, or ranges of numbers, are to be used by the random number generator. This random selection is weighted as discussed above. Having chosen a table, a selection is made by the random number generator, the random number generated by the random number generator is then transmitted to the stepper mechanism controller which controls the spinning of the reel. This process is repeated for each reel. The main machine controller then waits for acknowledgement that the spinning of the reels has been completed and then proceeds to make a pay, if required by the occurrence of a winning combination of reel positions.

As with prior art two table machines, such as that described in the applicant's publications GB2210489A and GB2211338A, the embodiment using the tables of FIG. 3 chooses to operate either in table A or table B, preferably on a random basis to ensure that for any game the player always has a chance of a jackpot. However the sequence of events is quite different to that of prior art two table machines. The player with credit presses the start button or handle causing table A or table B to be selected on a random basis (which may or may not be weighted). A random number is chosen from the range of numbers provided on the selected table and the reels are spun. The reel is then stopped at the stopping position matching the random number.

This is done directly and no mapping step is required, unlike the Telnaes arrangement in which, after the random number is chosen, a table has to be consulted to determine which symbol on the reel strip is to be displayed.

FIG. 5 illustrates a control process in flow diagram form for a three reel machine 10 where each reel is driven in accordance with the present invention as exemplified in FIG. 3. In this sequence, a player with a credit established in the machine operates the start switch 40 causing the machine to select 41 between table A and table B for the stopping of reel 1. The random number generator then selects the number 42 from the selected table, the reels are all spun 43 and reel 1 is stopped at the selected position 44. A selection is then made 45 between table A and table B for the stopping of reel 2, a random number chosen 46 from the selected table and reel 2 is then stopped at the selected position 47. Finally, a selection is made 48 between tables A and B for the stopping of reel 3, a random number is chosen from the selected table 49 and the third reel is stopped at the selected position 50. The machine will then decide if a payout is required and make any such payout 51.

Note that the same set of subset tables may be used for each reel, or a different set may be used for one or all of the reels.

FIG. 6 is illustrative of an alternative embodiment of the invention, wherein there are three subset tables, table A, B and C. In this case, tables A and B include three numbers each and table C includes the rest of the numbers available (including numbers 4 and 5 not actually shown in table C on the drawing). Tables A and B both include numbers 2 and 7 which are mapped to jackpot symbols ("7" and "BAR") on the physical reel strip. The two jackpots need not occur with equal probability, depending on any weighting applied to the random selector 101.

Weighting may be applied to the random selector by any known means.

Any number of tables may be used in the present invention, as long as the total amount of random numbers adds up to the same amount of random numbers available for the physical reel strip.

Any number of reels may be driven, from one set of tables, a set of tables which are separate for each reel, and any combination in between this. Different numbers of subset tables may be used for each reel.

While the present invention has been described for slot machines having stepping motor driven reel displays, it will be recognised that video displays, machines using endless bands or discs, or any other display having the capability to display a selected symbol or indicia may equally make use of the invention as described.

It will be noted that the invention operates by utilising random numbers for each display position available. Usually only one symbol is displayed per display position but the invention is not limited to this. For example, two symbols or three symbols could be displayed for every position and in this case only one random number would be needed for the three symbols. The three symbols together still count as one "indicium".

The invention has been described for a three reel multi line machine. Other types of machines could be used, for example multiplier machines, single reel machines, etc. could utilise the present invention.

The subset tables may have any number of members, all the way down to one member.

In a system with more than two tables, for example that illustrated in FIG. 6, using Tables A, B and C. Those tables can be utilised in any fashion, for example, with the following results: a table selection of A+B:C gives jackpots of equal probability and any size required.

Table selection by either A: B+C or B: A+C - gives jackpots of unequal size. The one relating to C having the same frequency as common symbols would be a low value jackpot.

Also, the random selection could be done in a number of steps. Consider the Boolean algebra example as above with three tables. Choice could be made first between table C as one alternative and tables A and B as the other alternative. A further random selection could then be made between tables A and C so that tables A and B are chosen after the first selection step.

The invention has been described in relation to stepper motor driven machines. Any drive could be used.

I claim:

1. A gaming machine comprising:

display means arranged to display at least one indicium selected from a set of plurality of possible indicia;

random selection means for selecting the indicium to be displayed on said display means from the set of indicia, said random selection means including random number generation means for generating a random number from a set of numbers each member of which uniquely corresponds to one indicium of the set of possible indicia, wherein the set of numbers are divided between a plurality of subset tables, at least one of the subset tables containing a plurality of members; and selection means for selecting, between the subset tables, a subset table to be used for selecting the indicium to be displayed, whereby the random number generation means makes a selection from the selected table and said display means is responsive to the selected number to display the corresponding indicium.

2. A gaming machine in accordance with claim 1, wherein at least two of the subset tables contain unequal numbers of members.

3. A gaming machine in accordance with claim 1, wherein said selection means is arranged to make a weighted selection between the subset tables.

4. A gaming machine in accordance with claim 3, wherein two of the subset tables contain unequal numbers of members.

5. A gaming machine in accordance with claim 1, wherein said plurality of subset tables consists of two subset tables.

6. A gaming machine in accordance with claim 5, wherein the selection means is arranged to make a weighted selection between the two subset tables.

7. A gaming machine in accordance with claim 5, wherein a first of the two subset tables contains less members than a second of the two subset tables, one of the members of the first table being a number corresponding to a jackpot indicium.

8. A gaming machine in accordance with claim 7, wherein the first subset table contains three numbers.

9. A gaming machine in accordance with claim 1, wherein said plurality of subset tables consists of at least three subset tables.

10. A gaming machine in accordance with claim 9, wherein said selection means is arranged to make a weighted selection between the at least three subset tables.

11. A gaming machine in accordance with claim 9, wherein a first and a second of the at least three subset tables each contain less members than a third of the at least three subset tables, one of the members of the first and second tables, respectively, being a number corresponding to a jackpot indicium.

12. A gaming machine in accordance with claim 11, wherein said plurality of subset tables consists of three subset tables, and the first and second tables contain equal numbers of members.

13. A gaming machine in accordance with claim 12 wherein the first and second subset tables contain three numbers each.

14. A gaming machine in accordance with claim 1, wherein said display means includes at least one reel mounting the indicia.

15. A method of operating a gaming machine, having display means arranged to display at least one indicium selected from a set of a plurality of possible indicia, the machine being provided with a plurality of numbers representing indicia displayable by the display means, each displayable indicium being represented by a uniquely corresponding respective number, the plurality of numbers being divided into a plurality of subset tables, at least one of the subset tables having a plurality of members, the method of operation comprising the steps of:

selecting each indicium for display by randomly selecting one of the subset tables;

randomly selecting one number from a selected subset table; and displaying the indicium corresponding to the selected number.

16. A method in accordance with claim 15, wherein at least two of the subset tables contain unequal numbers of members.

17. A method in accordance with claim 15, wherein the step for randomly selecting one of the subset tables is weighted in preference to at least one of the subset tables.

18. A method in accordance with claim 17, wherein at least two of the subset tables contain unequal numbers of members.

19. A method in accordance with claim 15, wherein said plurality of subset tables consists of two subset tables.

20. A method in accordance with claim 19, wherein the step for randomly selecting one of the subset tables is weighted in preference to one of the two subset tables.

21. A method in accordance with claim 19, wherein a first of the two subset tables contains less members than a second of the two subset tables, one of the members of the first table being a number corresponding to a jackpot indicium.

22. A method in accordance with claim 21, wherein the first subset table contains three numbers.

23. A method in accordance with claim 15, wherein said plurality of subset tables consists of at least three subset tables.

24. A method in accordance with claim 23, wherein the step for randomly selecting one of the subset tables is weighted in preference to at least one of the at least three subset tables.

25. A method in accordance with claim 23, wherein a first and a second of the at least three subset tables each contain less members than a third of the at least three subset tables, one of the members of the first and second table respectively, being a number corresponding to a jackpot indicium.

26. A method in accordance with claim 25, wherein said plurality of at least three subset tables consists of three subset tables and the first and second tables contain equal numbers of members.

27. A method in accordance with claim 26, wherein the first and second tables contain three numbers each.

28. A method in accordance with claim 25, wherein the display means of the gaming machine includes at least one reel mounting the indica.

29. A gaming machine comprising:

control means for controlling operation of the machine;

display means including a plurality of display positions, for displaying combinations of indicia; and reward means for returning a reward to a player of the machine in response to certain predetermined indicia combinations being displayed on said display means at the end of the game, said display means including a plurality of reels mounting the indicia, random selection means for selecting the indicium to be displayed by at least one of the reels from a set of a plurality of possible indicia for the at least one reel, the random selection means including random number generation means for generating a random number from a set of numbers each member of which uniquely corresponds to one indicium of the set of possible indicia, wherein the set of numbers are divided between a plurality of subset tables, at least one of the subset tables containing a plurality of members, and selection means arranged for selecting between the subset tables, a subset table to be used for selecting the indicium to be displayed whereby a random generation means makes a selection from the selected table and the reel is responsive to the selective number to display the correspondingly indicium.

* * * * *